US011180936B2

(12) United States Patent
Kim

(10) Patent No.: US 11,180,936 B2
(45) Date of Patent: Nov. 23, 2021

(54) POWER LATCH APPARATUS

(71) Applicants: Hyundai Motor Company, Seoul (KR); Kia Motors Corporation, Seoul (KR)

(72) Inventor: Duck Young Kim, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 414 days.

(21) Appl. No.: 16/257,757

(22) Filed: Jan. 25, 2019

(65) Prior Publication Data

US 2020/0131808 A1 Apr. 30, 2020

(30) Foreign Application Priority Data

Oct. 31, 2018 (KR) ..... 10-2018-0131650

(51) Int. Cl.

| | |
|---|---|
| ***E05B 81/06*** | (2014.01) |
| ***E05B 81/34*** | (2014.01) |
| *E05B 81/14* | (2014.01) |
| *E05B 81/20* | (2014.01) |

(52) U.S. Cl.

CPC ..... *E05B 81/06* (2013.01); *E05B 81/34* (2013.01); *E05B 81/14* (2013.01); *E05B 81/20* (2013.01); *E05Y 2900/531* (2013.01); *E05Y 2900/546* (2013.01)

(58) Field of Classification Search

CPC ..... E05B 81/06; E05B 81/34; E05B 81/14; E05B 81/20; E05Y 2900/531; E05Y 2900/546

See application file for complete search history.

(56) References Cited

U.S. PATENT DOCUMENTS

| | | | | |
|---|---|---|---|---|
| 5,678,869 | A | 10/1997 | Yoshikuwa | |
| 10,378,252 | B2 | 8/2019 | Ottino et al. | |
| 10,415,275 | B2 * | 9/2019 | Byun | E05B 81/16 |
| 10,619,384 | B2 | 4/2020 | Im et al. | |
| 2018/0163439 | A1 * | 6/2018 | Patane | E05B 81/36 |

(Continued)

FOREIGN PATENT DOCUMENTS

| | | | |
|---|---|---|---|
| CN | 105909089 | A | 8/2016 |
| CN | 107299799 | A | 10/2017 |
| CN | 107366481 | A | 11/2017 |

*Primary Examiner* — Kristina R Fulton

*Assistant Examiner* — James Edward Ignaczewski

(74) *Attorney, Agent, or Firm* — Mintz Levin Cohn Ferris Glovsky and Popeo, P.C.; Peter F. Corless

(57) ABSTRACT

A power latch apparatus is provided. The apparatus includes a rotary cam that is rotatably connected to a cam shaft and includes a cam groove, a transmission rod that is slidably connected to the cam groove and pressed and moved as the rotary cam rotates, and a claw to which the transmission rod is rotatably connected and that is pressed by the movement of the transmission rod to rotate about a claw shaft. The claw includes a claw recess that limits a striker movement that fits into the claw recess during a cinching operation, and a pawl to prevent the claw from rotating in a release direction in which a release operation of separating the striker from the claw recess is performed, or rotates about a pawl shaft while being pressed by the rotary cam, the pawl to allow the claw to rotate in the release direction.

11 Claims, 20 Drawing Sheets

(56) References Cited

U.S. PATENT DOCUMENTS

| | | | | |
|---|---|---|---|---|
| 2018/0171679 | A1* | 6/2018 | Im | E05B 83/18 |
| 2018/0171681 | A1* | 6/2018 | Hunt | E05B 81/14 |
| 2018/0347239 | A1* | 12/2018 | Im | E05B 81/16 |
| 2020/0102772 | A1* | 4/2020 | Ishiguro | E05B 81/14 |

* cited by examiner

1

POWER LATCH APPARATUS

CROSS-REFERENCE TO RELATED APPLICATION

This application is claims the benefit of priority to Korean Patent Application No. 10-2018-0131650, filed on Oct. 31, 2018, the entire contents of which are incorporated herein by reference.

TECHNICAL FIELD

The present disclosure relates to a power latch apparatus used in a power system of a vehicle, and more particularly, to a power latch apparatus that performs a release operation and a cinching operation with a single driving device.

BACKGROUND

A latch apparatus used in a power system (e.g., a door, a hood, a tailgate, a trunk, or the like) of a vehicle includes a release motor and a cinching motor to automatically implement an opening (release) operation and a closing (cinching) operation. The latch apparatus separately performs the operations in such a manner that for the release operation, the release motor is used and the cinching motor is stopped, and for the cinching operation, the cinching motor is used and the release motor is stopped.

Since the motors are provided separately, the conventional latch apparatus may be large in size and heavy in weight. Furthermore, manufacturing cost may increase due to a large number of parts, and the latch apparatus may break down due to a number of coupling or contact portions between the parts.

SUMMARY

The present disclosure provides a power latch apparatus used in a vehicle to perform a release operation and a cinching operation with a single driving device. The technical problems to be solved by the present inventive concept are not limited to the aforementioned problems, and any other technical problems not mentioned herein will be clearly understood from the following description by those skilled in the art to which the present disclosure pertains.

According to an aspect of the present disclosure, a power latch apparatus may include a rotary cam rotatably connected to a cam shaft and including a cam groove, a transmission rod slidably connected to the cam groove and pressed and moved by the cam groove as the rotary cam rotates, a claw to which the transmission rod is rotatably connected, the claw being pressed by the movement of the transmission rod to rotate about a claw shaft. The claw may include a claw recess for limiting movement of a striker that fits into the claw recess during a cinching operation of limiting the movement of the striker, and a pawl that makes contact with an outer surface of the claw to prevent the claw from rotating in a release direction in which a release operation of separating the striker from the claw recess is performed, or rotates about a pawl shaft while being pressed by the rotary cam, the pawl being separated from the outer surface of the claw to allow the claw to rotate in the release direction.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
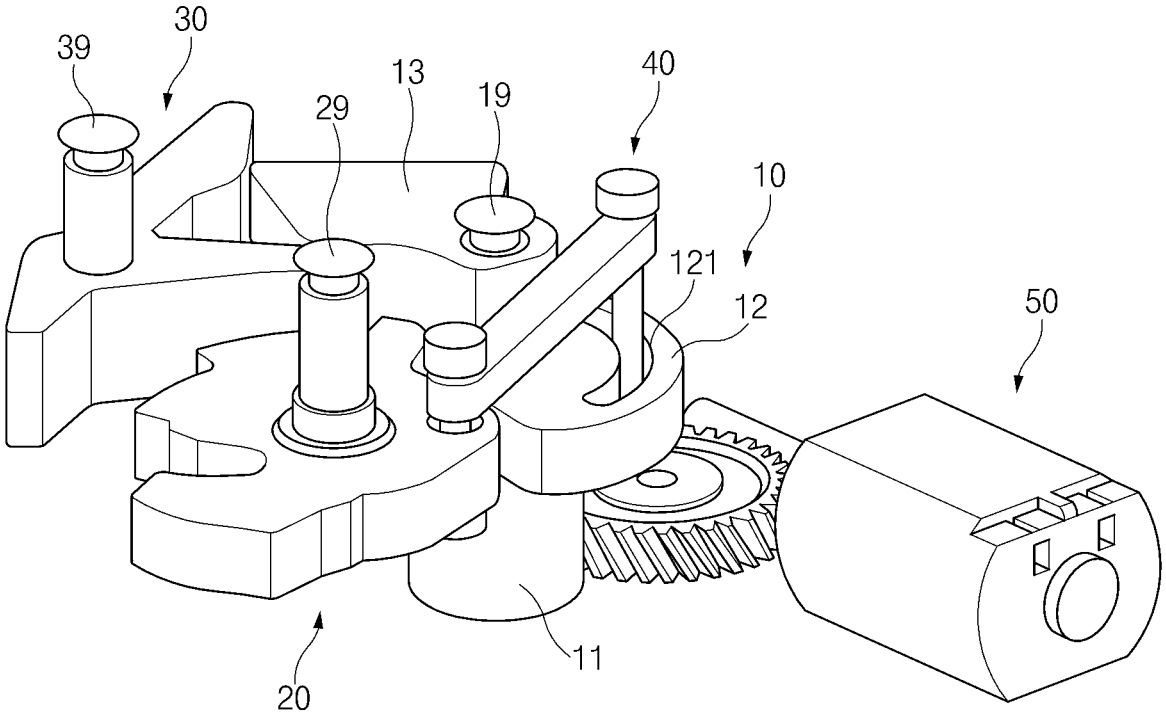
FIG. 1 is a perspective view illustrating a power latch apparatus according to an exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/of" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, exemplary embodiments of the present disclosure will be described in detail with reference to the accompanying drawings. It should be understood that even if shown in different drawings, identical components are provided with identical reference numerals in the drawings. Furthermore, in describing the exemplary embodiments of the present disclosure, detailed descriptions related to well-known functions or configurations will be omitted when they may make subject matters of the present disclosure unnecessarily obscure.

Terms, such as "first", "second", "A", "B", "(a)", "(b)", and the like, may be used herein to describe components of the present disclosure. Such terms are only used to distinguish one component from another component, and the substance, sequence, order, or number of these components is not limited by these terms. If a component were described as "connected", "coupled", or "linked" to another component, they may mean the components are not only directly "connected", "coupled", or "linked" but also are indirectly "connected", "coupled", or "linked" via a third component.

Figure 2:
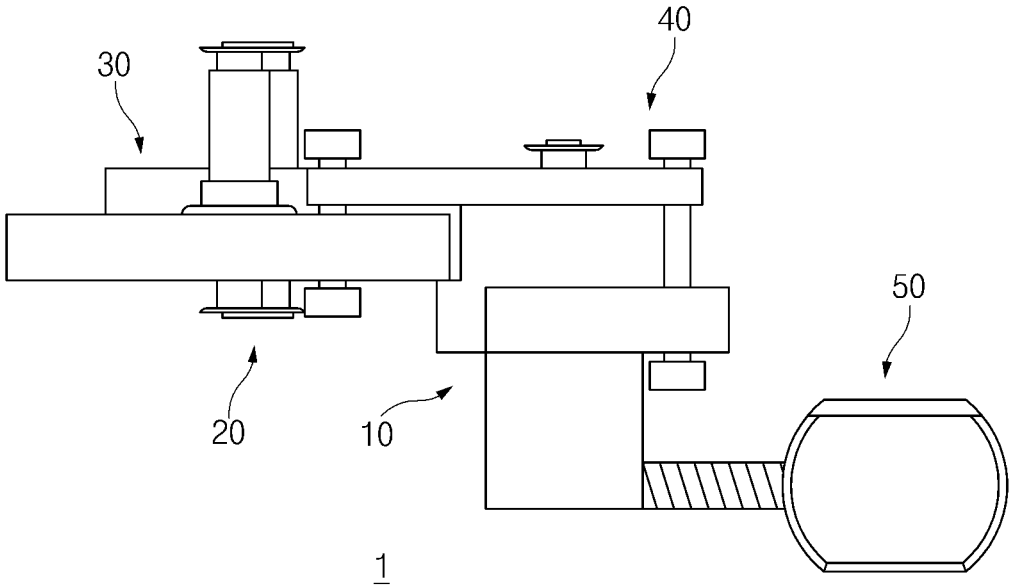
FIG. 2 is a side view illustrating the power latch apparatus according to the exemplary embodiment of the present disclosure.
Figure 3:
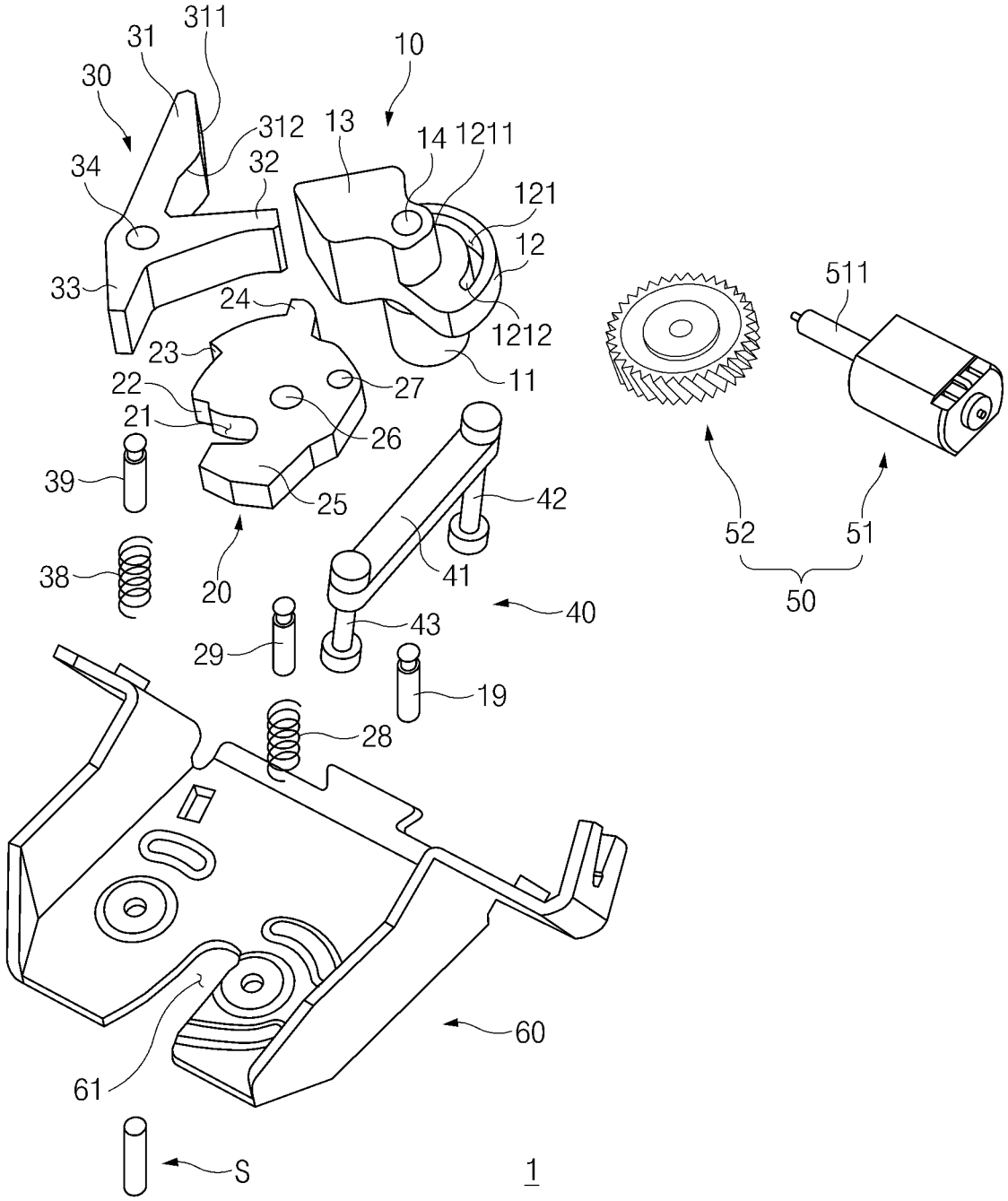
FIG. 3 is a detailed view illustrating the power latch apparatus according to the exemplary embodiment of the present disclosure.

FIG. 1 is a perspective view illustrating a power latch apparatus 1 according to an exemplary embodiment of the present disclosure. FIG. 2 is a side view illustrating the power latch apparatus 1 according to the exemplary embodiment of the present disclosure. FIG. 3 is a detailed view illustrating the power latch apparatus 1 according to the exemplary embodiment of the present disclosure.

Referring to FIGS. 1 to 3, the power latch apparatus 1 according to the exemplary embodiment of the present disclosure may include a rotary cam 10, a transmission rod 40, a claw 20, and a pawl 30. The power latch apparatus 1 may further include a driving device 50 and a housing 60. As used herein, the term "cinching operation" refers to an operation of limiting movement of a striker S, and the term "release operation" refers to an operation of allowing for movement of the striker S. The rotational direction for performing the release operation may be referred to as a release direction D2 (see FIG. 4), and the direction opposite to the release direction may be referral to as a cinching direction D1 (see FIG. 4). Although the release direction D2 and the cinching direction D1 are illustrated herein as the counterclockwise direction and the clockwise direction, respectively, the release direction D2 and the cinching direction D1 are not limited thereto.

The components of the power latch apparatus 1 according to the exemplary embodiment of the present disclosure may be coupled to, or accommodated in, the housing 60. The housing 60 may be a framework of the power latch apparatus 1 and may have, on a side thereof, a housing recess 61 into which the striker S is inserted. The striker S may be an object to which the power latch apparatus 1 of the present disclosure is fixed, or from which the power latch apparatus 1 is released.

Rotary Cam 10

The rotary cam 10 may be rotatably connected to a cam shaft 19. The rotary cam 10 may be configured to rotate in the release direction D2 or the opposite direction D1 to press and rotate other components of the present disclosure, performing the release operation or the cinching operation. The rotary cam 10 may be configured to rotate about the cam shaft 19. The rotary cam 10 may include a cam groove 121 for connection to the claw 20 through the transmission rod 40. The rotary cam 10 may further include a pawl contact part 13 configured to press and rotate the pawl 30.

The power latch apparatus 1 according to the exemplary embodiment of the present disclosure may further include the cam shaft 19, and the cam shaft 19 may be coupled to the housing 60. The rotary cam 10 may include a cam shaft connection aperture 14. The cam shaft 19 may be inserted into the cam shaft connection aperture 14 to rotatably connect the rotary cam 10 to the cam shaft 19. The position of the rotary cam 10 relative to the housing 60 may be fixed by the cam shaft 19, and therefore the rotary cam 10 may not be separated from the housing 60.

The rotary cam 10 may have a three-layer structure as illustrated. A first layer 11 of the rotary cam 10 may be connected to the driving device 50 that includes a motor 51 and a power transmission gear 52, and may be configured to receive a driving force generated by the motor 51, through the power transmission gear 52 engaged with a motor shaft 511. The rotary cam 10 may be rotated about the cam shaft 19 by the received driving force. Gear teeth may be formed on the outer circumferential surface of the first layer 11 of the rotary cam 10 and may be engaged with the power transmission gear 52. A second layer 12 seated on the first layer 11 of the rotary cam 10 may include the cam groove 121, and a third layer seated on the second layer 12 may include the pawl contact part 13. The cam shaft connection aperture 14 may be formed through all the layers of the rotary cam 10 with the three-layer structure.

The cam groove 121 may be a long narrow groove formed through the second layer 12 of the rotary cam 10. A cam rod 42 located at a first end of the transmission rod 40 may be slidably or rotatably inserted into the cam groove 121 and may be configured to rotate or move in the cam groove 121. The cam groove 121 in a long narrow groove shape may include a first end 1211 and a second end 1212 opposite to the first end 1211. The opposite ends of the cam groove 121 may prevent the cam rod 42 of the transmission rod 40 from further moving in the directions in which the opposite ends of the cam groove 121 face, when the cam rod 42 contacts the opposite ends of the cam groove 121.

The pawl contact part 13 may be formed in the third layer of the rotary cam 10. The pawl contact part 13 may be configured to rotate to press and rotate the pawl 30, causing the pawl 30 to allow for rotation of the claw 20. The outer surface of the pawl contact part 13 may have an arrow head shape (e.g., triangular or cone shaped) pointing toward the pawl 30 as illustrated, but is not limited thereto. The directions in which the third layer and the second layer 12 of the rotary cam 10 protrude from the cam shaft connection aperture 14 may differ from each other as illustrated. The pawl contact part 13 and the cam groove 121 may be disposed in different positions along the direction in which the cam shaft 19 extends. Accordingly, when the pawl contact part 13 contacts (e.g., surface contact with) the pawl 30, the second layer 12 of the rotary cam 10 may be separated from the pawl 30 (e.g., does not contact the pawl), and the transmission rod 40, part of which is accommodated in the cam groove 121, be prevented from colliding with the pawl 30.

When the rotary cam 10 rotates to perform the cinching operation, the first end of the transmission rod 40 may be pressed by the first end 1211 of the cam groove 121, and a second end (e.g., an opposite end) of the transmission rod 40 may rotate the claw 20. When the rotary cam 10 rotates to perform the release operation, the rotary cam 10 may be configured to press and rotate the pawl 30, and the pawl 30 may be rotated and separated from the claw 20 to allow for rotation of the claw 20. As the claw 20 rotates, the second end of the transmission rod 40 may be pressed by the claw 20, and the first end of the transmission rod 40 may slide along the cam groove 121. Specific processes in which the cinching operation and the release operation are performed by the rotation of the rotary cam 10 will be described below with reference to FIGS. 4 to 20.

The rotary cam 10 may be moved to an original position by the driving device 50 after the cinching operation or the release operation is completed. The original position of the rotary cam 10, where the rotary cam 10 stands ready for performing the cinching operation or the release operation, may correspond to the position of the rotary cam 10 illustrated in FIGS. 4 and 12.

Transmission Rod 40

The transmission rod 40 may be rotatably and slidably connected to the cam groove 121 and may be pressed and moved by the cam groove 121 as the rotary cam 10 rotates. Although the transmission rod 40 has been described as being rotatably and slidably connected to the cam groove 121, the transmission rod 40 may be connected to the cam groove 121 to be only slidable. Furthermore, the transmission rod 40 may be rotatably connected to the claw 20. Accordingly, as the claw 20 rotates, the transmission rod 40 may be pressed to move and rotate. The transmission rod 40 may be configured to rotate or slide in the cam groove 121.

Further, the transmission rod 40 may include a rod body 41, and the cam rod 42 and a claw rod 43 formed at opposite ends of the rod body 41. The rod body 41 may have a rod shape that extends in one direction. The rod body 41 may extend over the claw 20 and the rotary cam 10 when viewed in a direction parallel to the cam shaft 19. The cam rod 42 and the claw rod 43 may be formed at the opposite ends of the rod body 41. The cam rod 42 may be slidably and rotatably connected to the cam groove 121 and may be connected to a first end of the rod body 41 to be slidable in a direction perpendicular to the extension direction of the rod body 41. The cam rod 42 may be formed in a rod shape that extends in the direction perpendicular to the extension direction of the rod body 41.

The claw rod 43 may be rotatably connected to a rod connection aperture 27 included in the claw 20 and may be connected to the second or opposite end of the rod body 41 to be slidable in the direction perpendicular to the extension direction of the rod body 41. The claw rod 43 may be formed in a rod shape that extends in the direction perpendicular to the extension direction of the rod body 41. When the rotary cam 10 rotates in the cinching direction D1, the cam rod 42 may be pressed and moved by the first end 1211 of the cam groove 121 in the cinching direction D1. As the cam rod 42 is moved, the claw 20 connected to the claw rod 43 located at the second end of the rod body 41 may be pressed and rotated in the cinching direction D1. In contrast, when the claw 20 rotates in the cinching direction D1, the claw rod 43 may be pressed and moved by the claw 20 in the cinching direction D1. As the claw rod 43 is moved, the cam rod 42 located at the first end of the rod body 41 may slide along the cam groove 121.

Claw 20

The claw 20 may be configured to limit movement of the striker S to perform the cinching operation, or may be separated from the striker S not to engage with the striker S, performing the release operation. The claw 20 may be pressed by movement of the transmission rod 40, which is rotatably connected thereto, to rotate about a claw shaft 29 in the release direction D2 or the opposite direction D1. Accordingly, the striker S may fit into the claw 20, or the claw 20 may be separated from the striker S, to perform the cinching operation or the release operation. To perform the above-described operation, the claw 20 may include a claw recess 21. The claw recess 21 may be concavely formed and may be configured to limit movement of the striker S during the cinching operation. To form the claw recess 21, an L-shaped claw step 25 may be formed to surround the claw recess 21.

The power latch apparatus 1 according to the exemplary embodiment of the present disclosure may further include the claw shaft 29, and the claw shaft 29 may be coupled to the housing 60. The claw 20 may include a claw shaft connection aperture 26. The claw shaft 29 may be inserted into the claw shaft connection aperture 26 to rotatably connect the claw 20 to the claw shaft 29. The position of the claw 20 relative to the housing 60 may be fixed by the claw shaft 29, and therefore the claw 20 may not be separated from the housing 60.

The claw 20 may have a plurality of stopping surfaces. Specifically, in an exemplary embodiment of the present disclosure, the claw 20 may include a first stopping surface 22, a second stopping surface 23, and a third stopping surface 24. When the claw 20 is about to rotate in the release direction D2, each stopping surface may contact the pawl 30 to prevent the claw 20 from rotating. When the cinching operation is completed and the power latch apparatus 1 is in a closed state, the first stopping surface 22 may contact the pawl 30 to prevent the claw 20 from rotating in the release direction D2. When the release operation is completed, the third stopping surface 24 may contact the pawl 30 to prevent the claw 20 from further rotating in the release direction D2.

The second stopping surface 23 may be disposed between the first stopping surface 22 and the third stopping surface 24. The second stopping surface 23 may contact the pawl 30 to prevent the claw 20 from rotating in the release direction D2 when the claw 20 is pressed and rotated by the striker S entering the claw recess 21 in the state in which the release operation is completed. In other words, the second stopping surface 23 may stop the claw 20 by contacting the pawl 30 in an intermediate state, rather than in a completely cinched or released state. The intermediate state may be referred to as a firstly released state, and the completely released state may be referral to as a secondly released state. Additionally, in view of the cinching operation, the firstly released state may be referral to as a firstly locked state in which locking is firstly performed.

The distance from the claw shaft connection aperture 26, where the claw shaft 29 is connected to the claw 20, to the first stopping surface 22 may be less than the distance from the claw shaft 29 to the second stopping surface 23. Furthermore, the distance from the claw shaft connection aperture 26 to the second stopping surface 23 may be less than the distance from the claw shaft connection aperture 26 to the third stopping surface 24. Accordingly, the outer surface of the claw 20 may have a stepped structure from the first stopping surface 22 to the third stopping surface 24. The pawl 30 may sequentially contact the first stopping surface 22, the second stopping surface 23, and the third stopping surface 24 along the outer surface of the claw 20 in the cinching direction D1.

The distance from the claw shaft 29 to the outer surface of the claw 20 before the pawl 30 contacts the first stopping surface 22 may be constant. In addition, the distance from the claw shaft 29 to the outer surface of the claw 20 between the first stopping surface 22 and the second stopping surface 23 may be constant. The distance from the claw shaft 29 to the outer surface of the claw 20 between the second stopping surface 23 and the third stopping surface 24 may be constant. Accordingly, the pawl 30 may not be pressed and rotated by the claw 20 until the pawl 30 reaches the first stopping surface 22 along the outer surface of the claw 20, and the same is true of the second stopping surface 23 or the third stopping surface 24.

The power latch apparatus 1 according to the exemplary embodiment of the present disclosure may further include the claw return elastic member 28. The claw return elastic member 28 may be formed of an elastic material and may be connected to the claw shaft 29 and the claw 20 and may surround the claw shaft 29. The claw return elastic member 28 may provide a restoring force to rotate the claw 20 in the release direction D2.

Pawl 30

The pawl 30 may contact the outer surface of the claw 20 to prevent the claw 20 from rotating in the release direction D2. The pawl 30 may be pressed and rotated by the rotary cam 10 and may be separated from the outer surface of the claw 20 to allow the claw 20 to rotate in the release direction D2. The power latch apparatus 1 according to the exemplary embodiment of the present disclosure may further include a pawl shaft 39, and the pawl shaft 39 may be coupled to the housing 60. The pawl 30 may include a pawl shaft connection aperture 34. The pawl shaft 39 may be inserted into the pawl shaft connection aperture 34 to rotatably connect the pawl 30 to the pawl shaft 39. The position of the pawl 30 relative to the housing 60 may be fixed by the pawl shaft 39, and therefore the pawl 30 may not be separated from the housing 60.

The directions in which the cam shaft 19, the claw shaft 29, and the pawl shaft 39 extend may be parallel to each other. The cam shaft 19, the claw shaft 29, and the pawl shaft 39 may be spaced apart from each other, rather than being located on the same line. The pawl 30 may include a cam contact part 31 and a claw contact part 32. The pawl 30 may further include a protrusion 33. As illustrated, the cam contact part 31 and the claw contact part 32 may extend from the pawl shaft connection aperture 34, to which the pawl shaft 39 is connected, toward the rotary cam 10 and the claw 20, respectively, to form the pawl 30 in a "V" shape.

The cam contact part 31 may be a portion of the pawl 30 that is pressed by rotation of the rotary cam 10 to rotate the pawl 30. The cap contact part 31 may include a first portion 311 and a second portion 312 to correspond to the shape of the pawl contact part 13 of the rotary cam 10. The first portion 311 may have a gradually decreasing width farther away from the pawl shaft 39, and the second portion 312 may be disposed between the first portion 311 and the pawl shaft 39 and may have a gradually increasing width farther away from the pawl shaft 39. The outer surface of the first portion 311 may be continuous with the outer surface of the second portion 312. The cam contact part 31 may contact the pawl contact part 13 at the first portion 311.

Additionally, the claw contact part 32 may contact the claw 20 to prevent the claw 20 from rotating in the release direction D2. The claw contact part 32 may contact the first stopping surface 22, the second stopping surface 23, and the third stopping surface 24 that are included in the claw 20. The protrusion 33 may extend from the pawl shaft connection aperture 34 in one direction (e.g., a first direction) that is different from the extension directions of the cam contact part 31 and the claw contact part 32.

The power latch apparatus 1 according to the exemplary embodiment of the present disclosure may further include a pawl return elastic member 38. The pawl return elastic member 38 may be formed of an elastic material and may be connected to the pawl shaft 39 and the pawl 30 and may surround the pawl shaft 39. The pawl return elastic member 38 may provide a restoring force to rotate the pawl 30 in the cinching direction D1.

As the rotary cam 10 rotates in the release direction D2, the claw 20 and the pawl 30 may rotate in the release direction D2 to perform the release operation. As the rotary cam 10 rotates in the opposite direction (e.g., a second direction) to the release direction D2, the claw 20 and the pawl 30 may rotate in the opposite direction to the release direction D2 to perform the cinching operation. Specific descriptions of the operations will be given below with reference to FIGS. 4 to 20.

Cinching Operation

Figure 4:
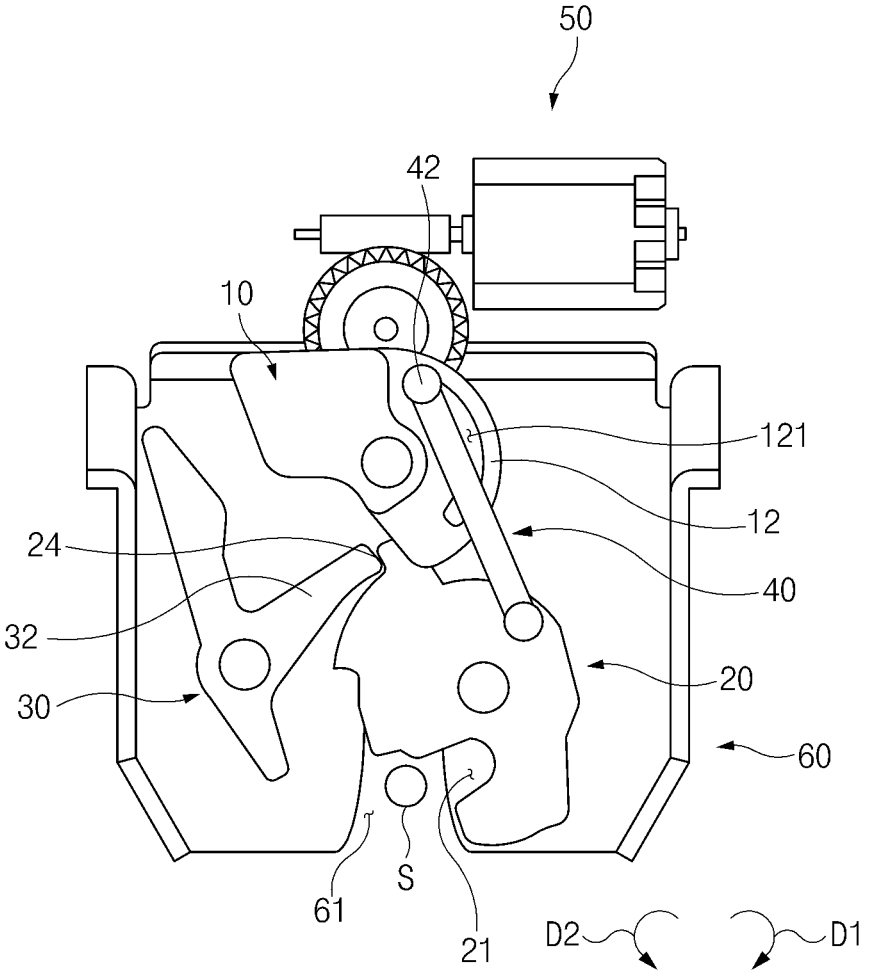
FIG. 4 is a plan view illustrating a released state of the power latch apparatus according to an exemplary embodiment of the present disclosure.
Figure 5:
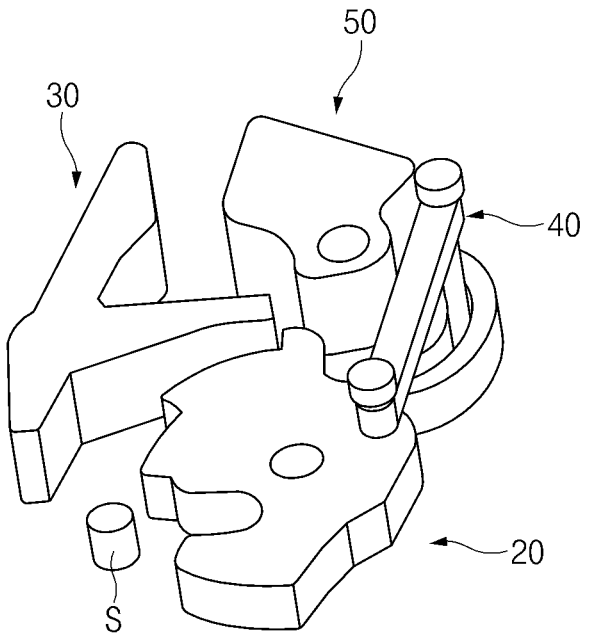
FIG. 5 is a perspective view illustrating the released state of the power latch apparatus according to the exemplary embodiment of the present disclosure.

FIG. 4 is a plan view illustrating a released state of the power latch apparatus 1 according to an exemplary embodiment of the present disclosure. FIG. 5 is a perspective view illustrating the released state of the power latch apparatus 1 according to the exemplary embodiment of the present disclosure. FIGS. 4 and 5 illustrate the released state in which a release operation is completed. The striker S may not fit into the claw recess 21, and the claw 20 may be maintained in this state by the pawl 30 contacting the third stopping surface 24.

Figure 6:
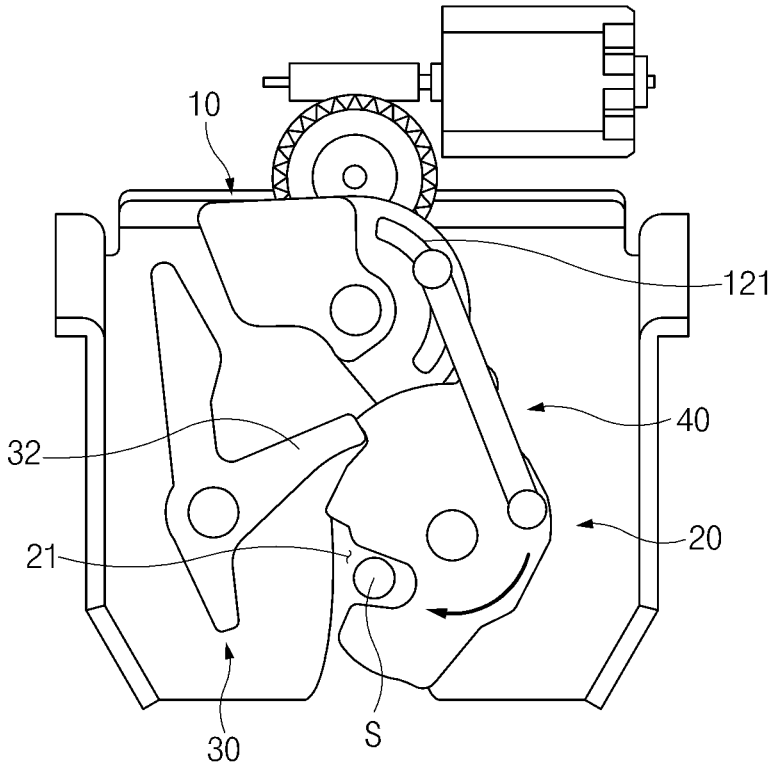
FIG. 6 is a plan view illustrating a firstly locked state of the power latch apparatus according to an exemplary embodiment of the present disclosure.
Figure 7:
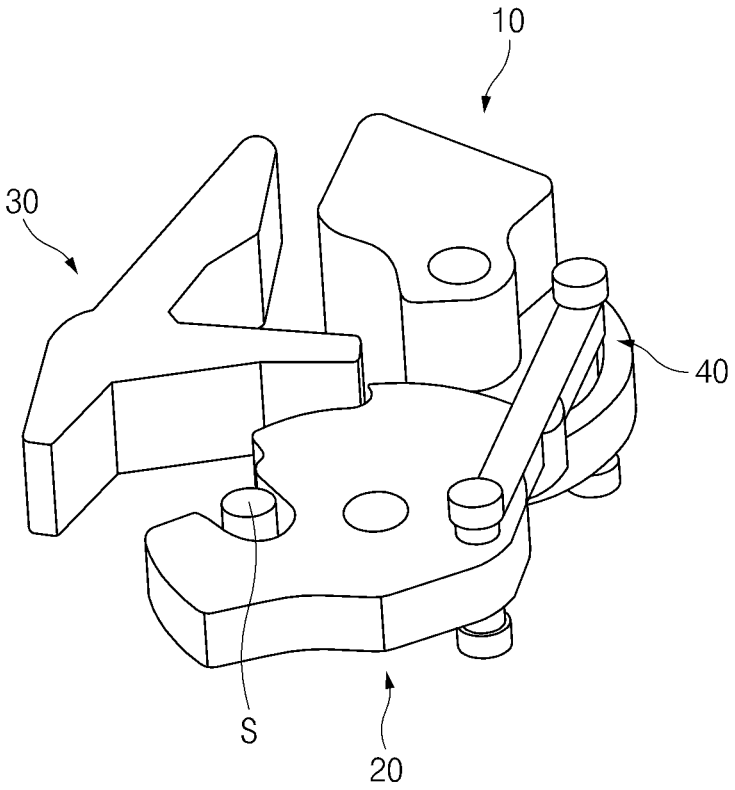
FIG. 7 is a perspective view illustrating the firstly locked state of the power latch apparatus according to the exemplary embodiment of the present disclosure.

FIG. 6 is a plan view illustrating a firstly locked state of the power latch apparatus 1 according to an exemplary embodiment of the present disclosure. FIG. 7 is a perspective view illustrating the firstly locked state of the power latch apparatus 1 according to the exemplary embodiment of the present disclosure. Referring to FIGS. 6 and 7, the striker S may move into the claw recess 21 while pressing and rotating the claw 20 in the cinching direction D1.

When a driver closes a trunk door, the striker S may be brought into contact with the claw 20 by the weight of the door and may fit into the claw recess 21 while pressing and rotating the claw 20 in the cinching direction D1 to perform first locking. The first locking may be electrically performed using an electric motor. For example, the first locking may be performed in such a manner that, when the striker S approaches within a predetermined distance to the claw 20, an approach detection device (not illustrated) may be configured to detect the approach of the striker S and operate the driving device 50 to rotate the claw 20 in the cinching direction D1. In other words, the firstly locked state may be reached by the driver's act of closing the door.

As the claw 20 rotates in the cinching direction D1 to perform the first locking, the pawl 30 contacting the third stopping surface 24 may slide and contact the second stopping surface 23 to prevent the claw 20 from rotating in the release direction D2. After the completion of the first locking, movement of the striker S may be limited by the claw 20. However, since the position of the striker S is not completely fixed by the claw recess 21, a cinching operation may be performed after the first locking. The power latch apparatus 1 may further include a lock detection device (not illustrated) configured to detect the completion of the first locking and transmit a control signal to the driving device 50.

Figure 8:
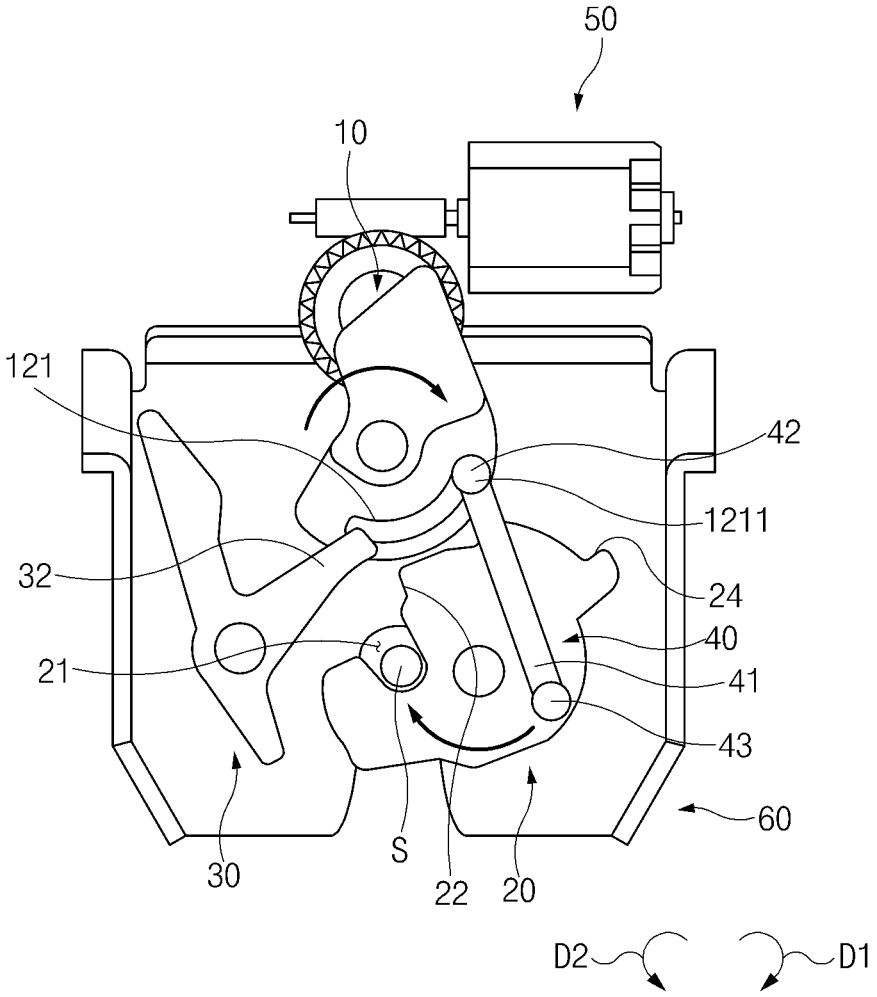
FIG. 8 is a plan view illustrating a cinching operation of the power latch apparatus according to an exemplary embodiment of the present disclosure.
Figure 9:
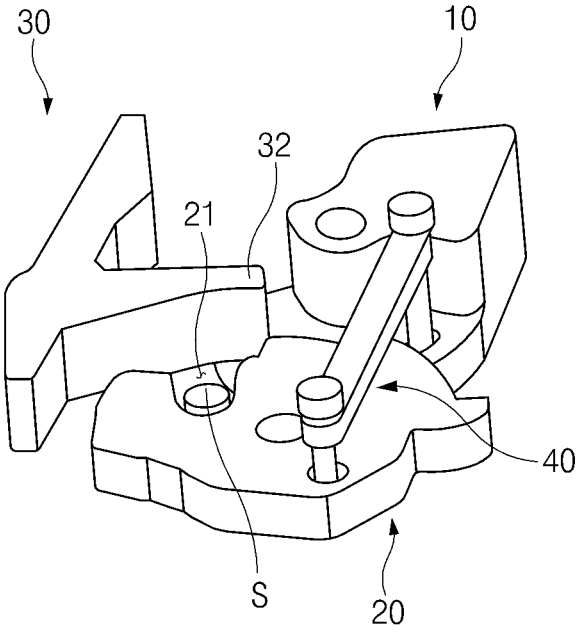
FIG. 9 is a perspective view illustrating the cinching operation of the power latch apparatus according to the exemplary embodiment of the present disclosure.

FIG. 8 is a plan view illustrating a cinching operation of the power latch apparatus 1 according to an exemplary embodiment of the present disclosure. FIG. 9 is a perspective view illustrating the cinching operation of the power latch apparatus 1 according to the exemplary embodiment of the present disclosure. Referring to FIGS. 8 and 9, the driving device 50 may be configured to operate to perform the cinching operation. The driving device 50 may be configured to generate a driving force and transmit the driving force to the first layer 11 of the rotary cam 10. The rotary cam 10 may be rotated in the cinching direction D1 by the driving force. The first end of the transmission rod 40 may be pressed by the first end 1211 of the cam groove 121 to move downward in the drawing. The claw 20 may be rotated in the cinching direction D1 by the second end of the transmission rod 40. Accordingly, the second stopping surface 23 of the claw 20 may be separated from the claw contact part 32 of the pawl 30. As the claw 20 rotates in the cinching direction D1, the striker S that fits into the housing recess 61 may be stopped and fixed by the claw recess 21.

Figure 10:
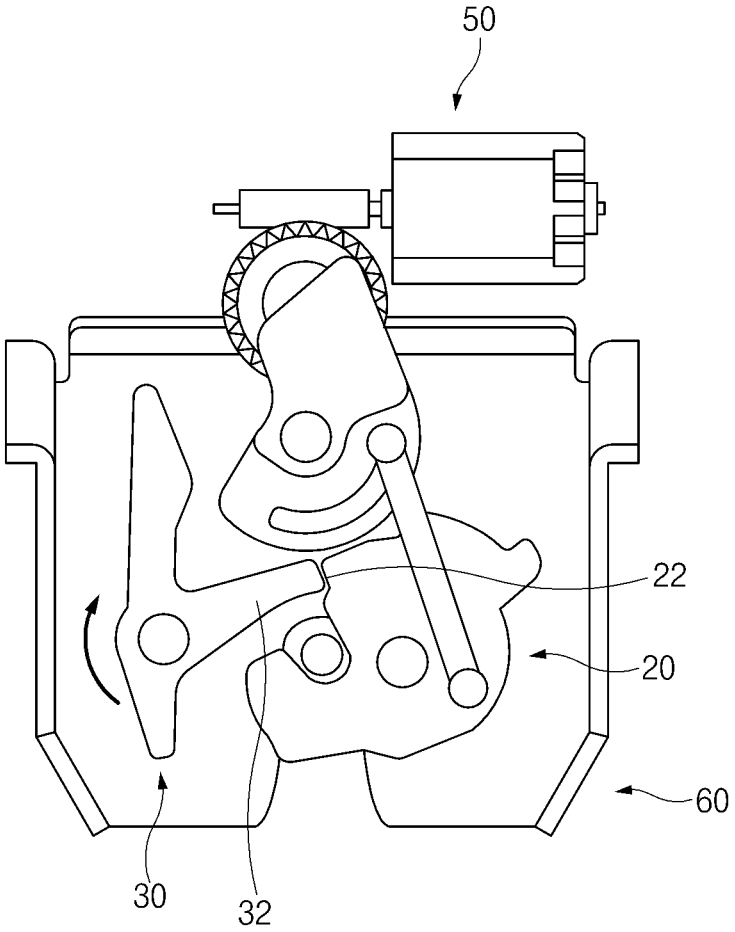
FIG. 10 is a plan view illustrating a situation in which a pawl moves to fix a cinched state of the power latch apparatus according to an exemplary embodiment of the present disclosure.
Figure 11:
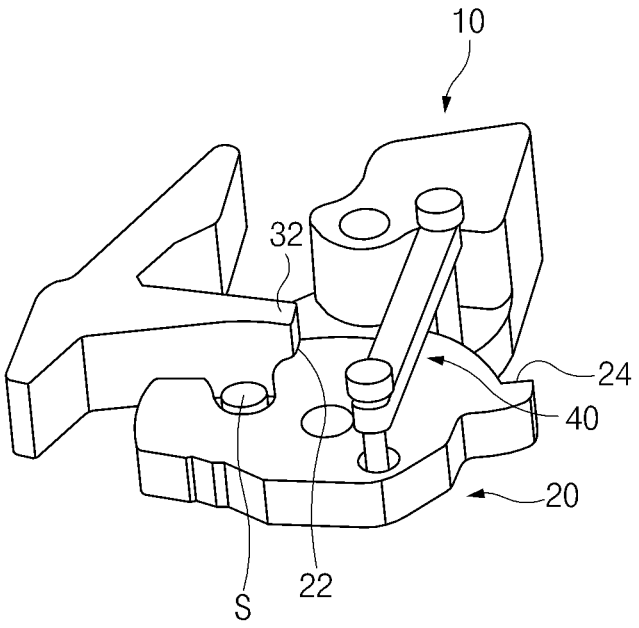
FIG. 11 is a perspective view illustrating the situation in which the pawl moves to fix the cinched state of the power latch apparatus according to the exemplary embodiment of the present disclosure.

FIG. 10 is a plan view illustrating a situation in which the pawl 30 moves to fix the cinched state of the power latch apparatus 1 according to an exemplary embodiment of the present disclosure. FIG. 11 is a perspective view illustrating the situation in which the pawl 30 moves to fix the cinched state of the power latch apparatus 1 according to the exemplary embodiment of the present disclosure. The pawl return elastic member 38 may be configured to exert a restoring force on the pawl 30 in the direction toward an original position of the pawl 30. The pawl 30 may be configured to rotate in the cinching direction D1 and contact the first stopping surface 22 of the claw 20 since the second stopping surface 23 of the claw 20 that prevents the pawl 30 from returning to the original position thereof is separated from the pawl 30. Accordingly, the claw 20 may be prevented from rotating in the release direction D2 in the state illustrated in FIGS. 10 and 11. Through the above-described process, the cinched state in which the striker S may be prevented from being separated from the claw 20 may be reached.

Figure 12:
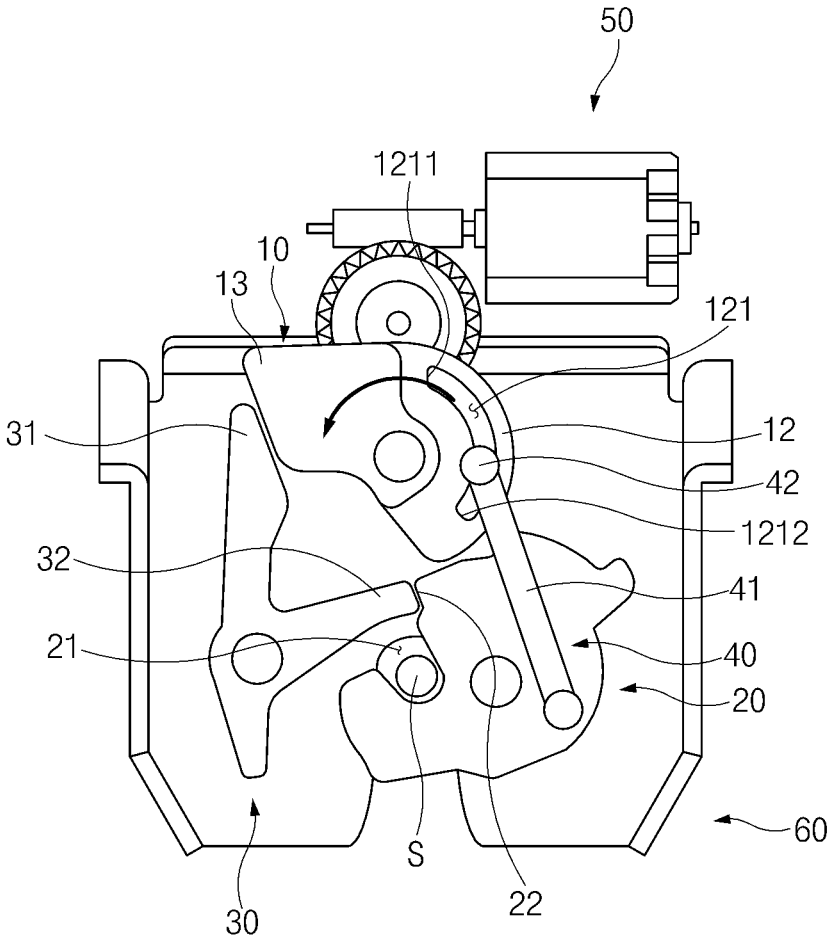
FIG. 12 is a plan view illustrating a situation in which a rotary cam returns to the original position in the cinched state of the power latch apparatus according to an exemplary embodiment of the present disclosure.
Figure 13:
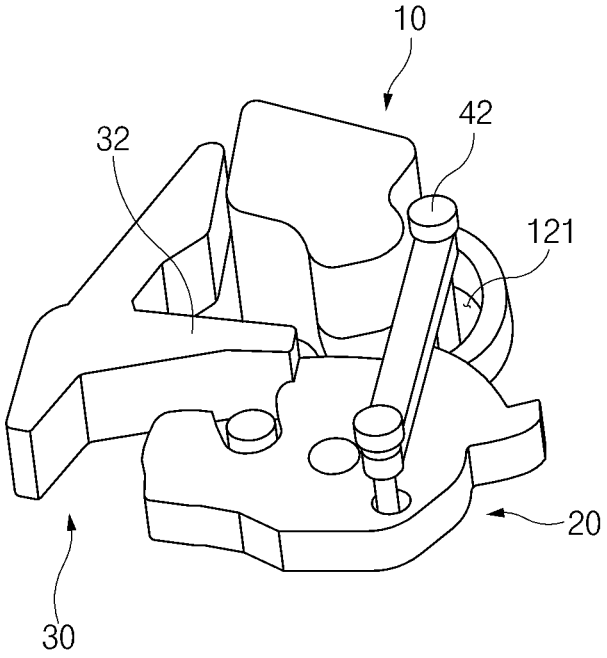
FIG. 13 is a perspective view illustrating the situation in which the rotary cam returns to the original position in the cinched state of the power latch apparatus according to the exemplary embodiment of the present disclosure.

FIG. 12 is a plan view illustrating a situation in which the rotary cam 10 returns to an original position in the cinched state of the power latch apparatus 1 according to an exemplary embodiment of the present disclosure. FIG. 13 is a perspective view illustrating the situation in which the rotary cam 10 returns to an original position in the cinched state of the power latch apparatus 1 according to the exemplary embodiment of the present disclosure.

Since the cinching operation is completed, the driving device 50 may be configured to transmit a driving force to the rotary cam 10 to allow the rotary cam 10 to rotate in the release direction D2 and move to an original position where the pawl contact part 13 does not contact the cam contact part 31 of the pawl 30. Even though the rotary cam 10 rotates, the cam rod 42 at the first end of the transmission rod 40 may slide in the cam groove 121, but may not contact the first end 1211 or the second end 1212 of the cam groove 121. Therefore, the transmission rod 40 may be prevented from moving or rotating.

Release Operation

Figure 14:
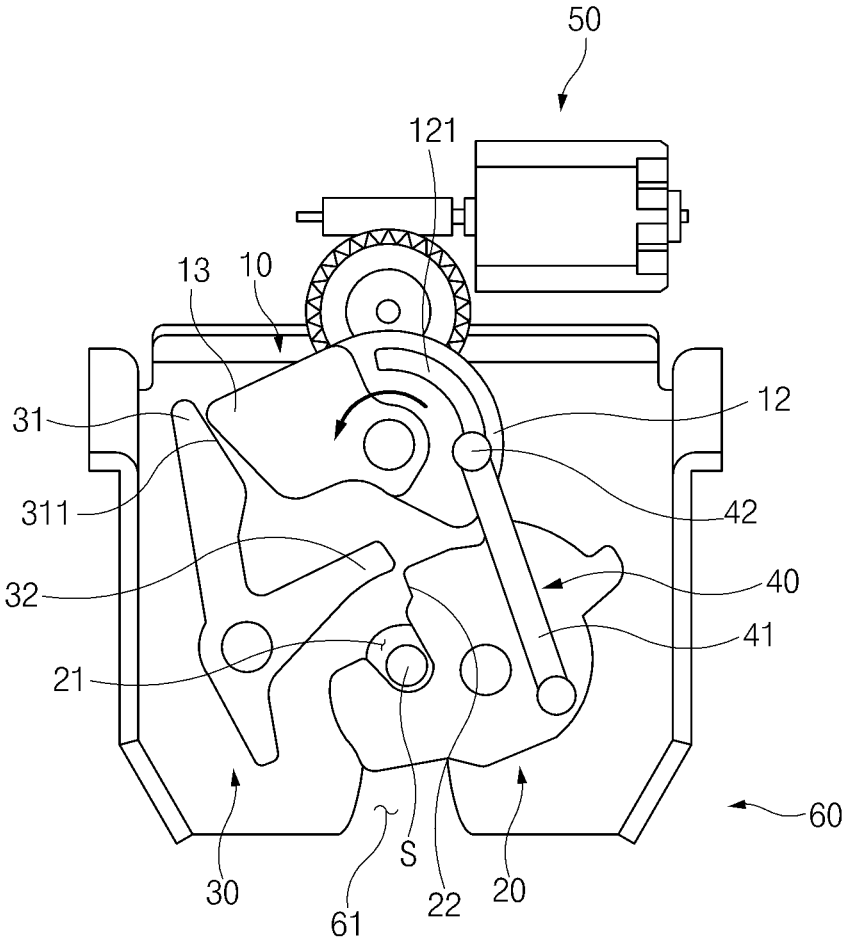
FIG. 14 is a plan view illustrating a situation in which the rotary cam rotates for a release operation of the power latch apparatus according to an exemplary embodiment of the present disclosure.
Figure 15:
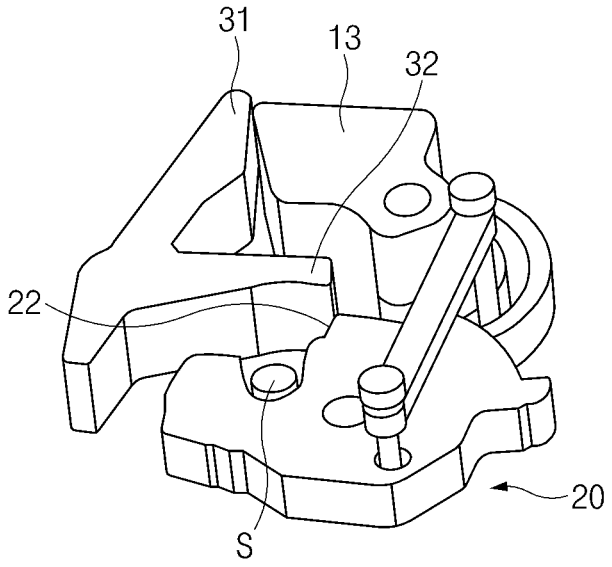
FIG. 15 is a perspective view illustrating the situation in which the rotary cam rotates for the release operation of the power latch apparatus according to the exemplary embodiment of the present disclosure.

FIG. 14 is a plan view illustrating a situation in which the rotary cam 10 rotates for a release operation of the power latch apparatus 1 according to an exemplary embodiment of the present disclosure. FIG. 15 is a perspective view illustrating the situation in which the rotary cam 10 rotates for the release operation of the power latch apparatus 1 according to the exemplary embodiment of the present disclosure.

The driving device 50 may be configured to operate to rotate the rotary cam 10 in the release direction D2 in the state in which the cinching operation is completed and the rotary cam 10 may return to an original position as illustrated in FIGS. 12 and 13. The pawl contact part 13 of the rotary cam 10 may contact the first portion 311 of the cam contact part 31 of the pawl 30 to rotate the pawl 30 in the release direction D2. The claw contact part 32 of the pawl 30 that rotates in the release direction D2 may be separated from the first stopping surface 22.

Figure 16:
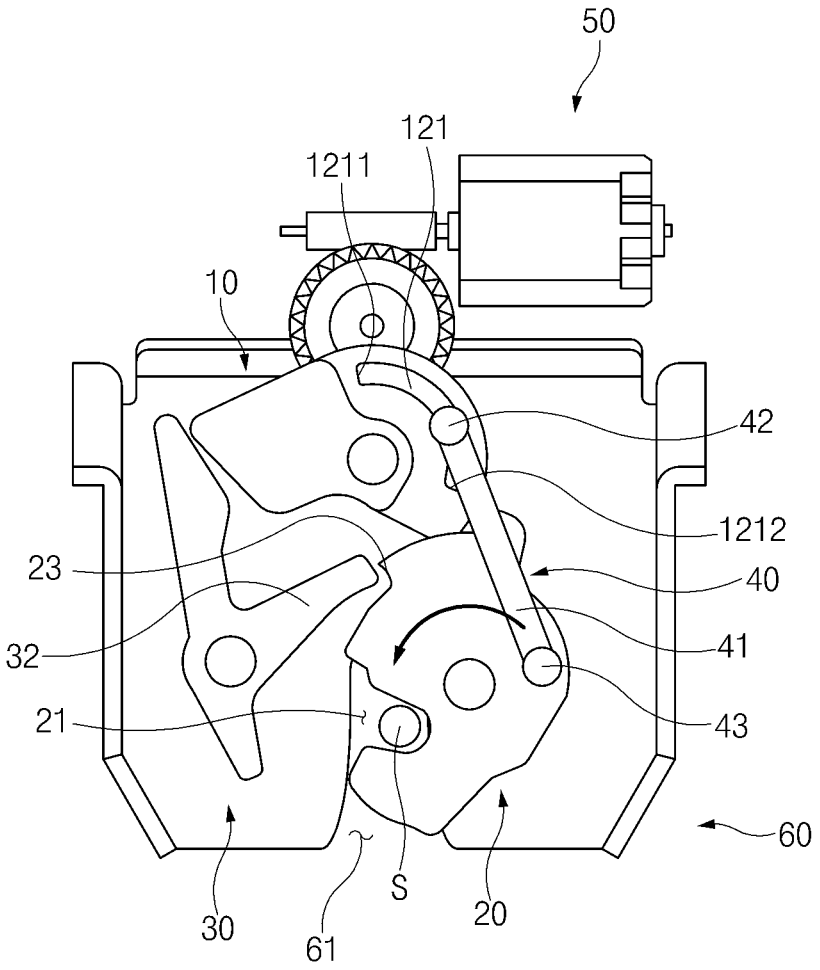
FIG. 16 is a plan view illustrating a situation in which a claw of the power latch apparatus rotates to reach an intermediate step according to an exemplary embodiment of the present disclosure.
Figure 17:
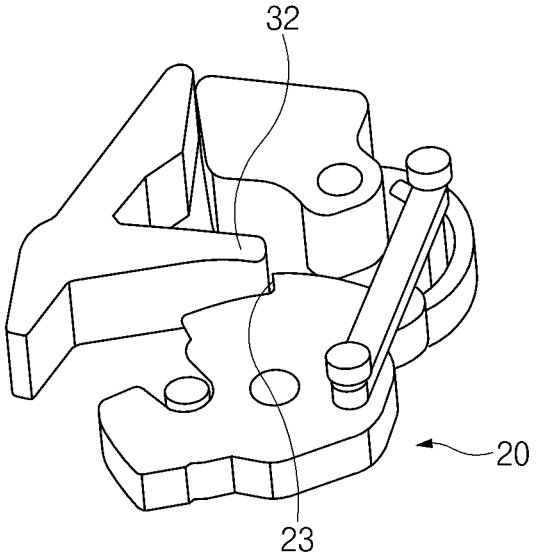
FIG. 17 is a perspective view illustrating the situation in which the claw of the power latch apparatus rotates to reach the intermediate step according to the exemplary embodiment of the present disclosure.

FIG. 16 is a plan view illustrating a situation in which the claw 20 of the power latch apparatus 1 rotates to reach an intermediate step according to an exemplary embodiment of the present disclosure. FIG. 17 is a perspective view illustrating the situation in which the claw 20 of the power latch apparatus 1 rotates to reach the intermediate step according to the exemplary embodiment of the present disclosure.

Since the pawl 30 may be separated from the outer surface of the claw 20, the claw 20 may be rotated in the release direction D2 toward an original position of the claw 20 by a restoring force exerted by the claw return elastic member 28. As the claw 20 is rotated in the release direction D2, the claw rod 43 of the transmission rod 40 may be pressed to rotate and move in the release direction D2, and therefore the transmission rod 40 may move to cause the cam rod 42 to move from the second end 1212 to the first end 1211 of the cam groove 121 along the cam groove 121. Since the cam rod 42 does not contact the first end 1211 or the second end 1212 of the cam groove 121, the rotary cam 10 may not be pressed by the transmission rod 40. The claw 20 may rotate in the release direction D2 until the second stopping surface 23 meets (e.g., contacts) the claw contact part 32 of the pawl 30. The second stopping surface 23 may contact the claw contact part 32 to prevent the claw 20 from further rotating in the release direction D2. Accordingly, the power latch apparatus 1 may reach the intermediate state.

Figure 18:
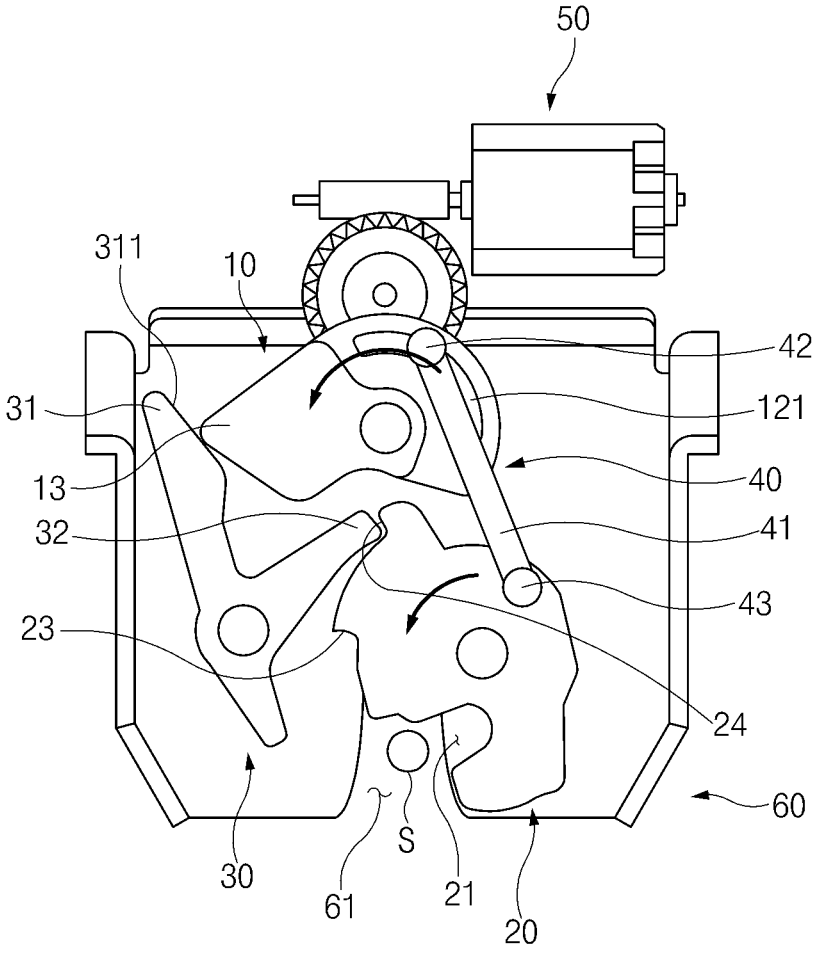
FIG. 18 is a plan view illustrating a situation in which a release operation of the power latch apparatus is performed according to an exemplary embodiment of the present disclosure.
Figure 19:
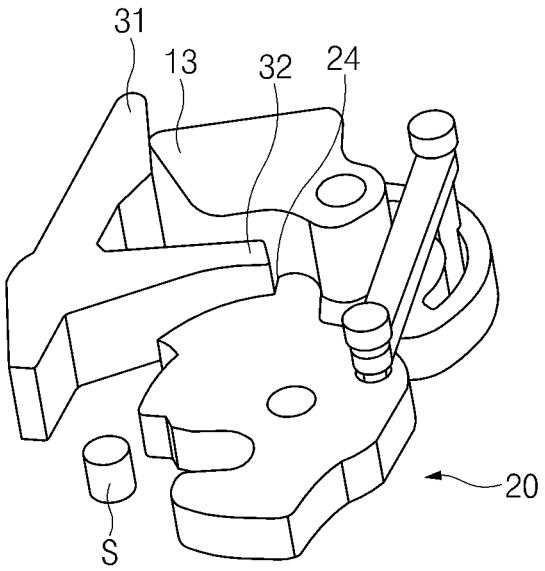
FIG. 19 is a perspective view illustrating the situation in which the release operation of the power latch apparatus is performed according to the exemplary embodiment of the present disclosure.

FIG. 18 is a plan view illustrating a situation in which a release operation of the power latch apparatus 1 is performed according to an exemplary embodiment of the present disclosure. FIG. 19 is a perspective view illustrating the situation in which the release operation of the power latch apparatus 1 is performed according to the exemplary embodiment of the present disclosure. The driving device 50 may be configured to operate to further rotate the rotary cam 10 in the release direction D2. The pawl contact part 13 of the rotary cam 10 may contact the first portion 311 of the cam contact part 31 of the pawl 30 to further rotate the pawl 30 in the release direction D2. The claw contact part 32 of the pawl 30 that rotates in the release direction D2 may be separated from the second stopping surface 23.

Since the pawl 30 may be separated from the outer surface of the claw 20, the claw 20 may be further rotated in the release direction D2 toward an original position of the claw 20 by a restoring force exerted by the claw return elastic member 28. As the claw 20 is further rotated in the release direction D2, the claw rod 43 of the transmission rod 40 may be pressed to rotate and move in the release direction D2, and therefore the transmission rod 40 may move to cause the cam rod 42 to move from the second end 1212 to the first end 1211 of the cam groove 121 along the cam groove 121. The cam rod 42 may not press the first end 1211 or the second end 1212 of the cam groove 121.

The claw 20 may be configured to rotate in the release direction D2 until the third stopping surface 24 contacts the claw contact part 32 of the pawl 30. The third stopping surface 24 may contact the claw contact part 32 to prevent the claw 20 from further rotating in the release direction D2. In this state, as illustrated, the claw 20 may be separated from the striker S, and the striker S may freely move downward along the housing recess 61. Accordingly, the power latch apparatus 1 may reach a completely released state, and the release operation may end.

Figure 20:
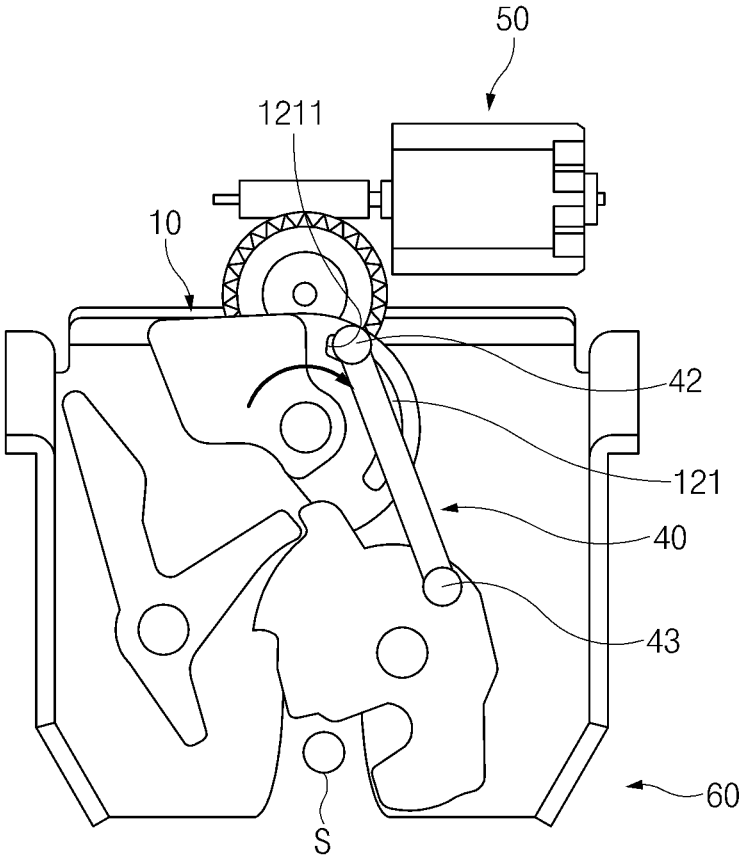
FIG. 20 is a plan view illustrating a situation in which the rotary cam returns to the original position in a released state of the power latch apparatus according to an exemplary embodiment of the present disclosure.

FIG. 20 is a plan view illustrating a situation in which the rotary cam 10 returns to an original position in the released state of the power latch apparatus 1 according to an exemplary embodiment of the present disclosure. FIG. 4, along with FIG. 20, will be referred to. Since the release operation is completed, the driving device 50 may be configured to transmit a driving force to the rotary cam 10 to allow the rotary cam 10 to rotate in the cinching direction D1 and move to an original position where the first end 1211 of the cam groove 121 does not press the cam rod 42.

As described above, the cinching operation and the release operation may be selectively performed without separate control, only by differentiating the operating direction of the driving device 50. According to the exemplary embodiments of the present disclosure, the release operation and the cinching operation may be selectively performed using the single driving device.

Hereinabove, even though all of the constituent components are coupled into one body or operate in a combined state in the description of the above-mentioned embodiments of the present disclosure, the present disclosure is not limited to these exemplary embodiments. In other words, all of the constituent components may operate in one or more selective combination within the range of the purpose of the present disclosure. Unless otherwise defined, all terms used herein, including technical and scientific terms, have the same meaning as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims. Therefore, the exemplary embodiments of the present disclosure are provided to explain the spirit and scope of the present disclosure, but not to limit them, so that the spirit and scope of the present disclosure is not limited by the exemplary embodiments. The scope of the present disclosure should be construed on the basis of the accompanying claims, and all the technical ideas within the scope equivalent to the claims should be included in the scope of the present disclosure.

What is claimed is:

1. A power latch apparatus, comprising:

a rotary cam rotatably connected to a cam shaft and including a cam groove;

a transmission rod slidably connected to the cam groove, wherein the transmission rod is pressed and moved by the cam groove as the rotary cam rotates;

a claw to which the transmission rod is rotatably connected, the claw being pressed by the movement of the transmission rod to rotate about a claw shaft, wherein the claw includes a claw recess configured to limit movement of a striker that fits into the claw recess during a cinching operation of limiting the movement of the striker; and a pawl configured to contact an outer surface of the claw to prevent the claw from rotating in a release direction in which a release operation of separating the striker from the claw recess is performed, or configured to rotate about a pawl shaft while being pressed by the rotary cam, the pawl being separated from the outer surface of the claw to allow the claw to rotate in the release direction.

2. The power latch apparatus of claim 1, wherein directions in which the cam shaft, the claw shaft, and the pawl shaft extend are parallel to each other, the claw and the pawl rotate in the release direction to perform the release operation as the rotary cam rotates in the release direction, and the claw and the pawl rotate in a direction opposite to the release direction to perform the cinching operation as the rotary cam rotates in the opposite direction to the release direction.

3. The power latch apparatus of claim 1, wherein the rotary cam further includes:

a pawl contact part configured to press and rotate the pawl while rotating, causing the pawl to allow the claw to rotate.

4. The power latch apparatus of claim 3, wherein the pawl contact part and the cam groove are disposed in different positions along a direction in which the cam shaft extends.

5. The power latch apparatus of claim 1, wherein a first end of the transmission rod is pressed by a first end of the cam groove and a second end of the transmission rod rotates the claw when the rotary cam rotates for the cinching operation, and the second end of the transmission rod is pressed by the claw, which rotates as the pawl is pressed by the rotary cam to rotate, and the first end of the transmission rod slides along the cam groove when the rotary cam rotates for the release operation.

6. The power latch apparatus of claim 1, wherein the pawl includes:

a cam contact part pressed by the rotation of the rotary cam to rotate the pawl; and a claw contact part configured to contact the claw to prevent the claw from rotating in the release direction.

7. The power latch apparatus of claim 6, wherein the cam contact part and the claw contact part extend toward the rotary cam and the claw, respectively, from a portion of the pawl where the pawl shaft is connected to the pawl.

8. The power latch apparatus of claim 1, wherein the claw includes a first stopping surface configured to contact the pawl to prevent the claw from rotating in the release direction when the cinching operation is completed.

9. The power latch apparatus of claim 8, wherein the claw further includes:

a second stopping surface configured to contact the pawl when the claw is pressed and rotated by the striker entering the claw recess, with the release operation completed, and a third stopping surface configured to contact the pawl to prevent the claw from rotating in the release direction when the release operation is completed.

10. The power latch apparatus of claim 9, wherein a distance from a position where the claw shaft is connected to the claw to the first stopping surface is less than a distance from the position where the claw shaft is connected to the claw to the second stopping surface, and the distance from the position where the claw shaft is connected to the claw to the second stopping surface is less than a distance from the position where the claw shaft is connected to the claw to the third stopping surface.

11. The power latch apparatus of claim 1, wherein the transmission rod includes:

a rod body;

a cam rod slidably and rotatably connected to the cam groove and connected to a first end of the rod body to be slidable in a direction perpendicular to an extension direction of the rod body; and a claw rod rotatably connected to the claw and connected to a second end of the rod body to be slidable in the direction perpendicular to the extension direction of the rod body.

* * * * *